US005685352A

United States Patent [19]

Faught

[11] Patent Number: 5,685,352

[45] Date of Patent: Nov. 11, 1997

[54] INDICATOR FUNNEL HAVING IMPROVED VERTICAL STABILITY

[76] Inventor: Edward N. Faught, 4050 Maloney Rd., Pinconning, Mich. 48650

[21] Appl. No.: 511,672

[22] Filed: Aug. 7, 1995

[51] Int. Cl.[6] ..... B65B 1/04

[52] U.S. Cl. ..... 141/331; 141/95

[58] Field of Search ..... 141/95, 199–205, 141/331–345, 297–300

[56] References Cited

U.S. PATENT DOCUMENTS

| | | | |
|---|---|---|---|
| D. 334,120 | 3/1993 | Faught | D7/700 |
| 721,870 | 3/1903 | Edison | 141/199 |
| 979,807 | 12/1910 | Squires | 141/340 |
| 986,535 | 3/1911 | Adams | 141/95 |
| 1,396,606 | 11/1921 | Vincent | 141/340 |
| 1,425,100 | 8/1922 | Jones et al. | 141/335 |
| 4,796,470 | 1/1989 | Lahde | 73/294 |
| 4,901,776 | 2/1990 | Attinello | 141/95 |

FOREIGN PATENT DOCUMENTS

| | | | |
|---|---|---|---|
| 347055 | 12/1935 | Italy | 141/204 |

*Primary Examiner*—Henry J. Recla
*Assistant Examiner*—Steven O. Douglas
*Attorney, Agent, or Firm*—Robert L. McKellar

[57] ABSTRACT

This invention deals with an improved indicator funnel having improved vertical stability, anti-back pressure features, and a float mechanism which is easily disengagable from the funnel.

1 Claim, 1 Drawing Sheet

INDICATOR FUNNEL HAVING IMPROVED VERTICAL STABILITY

The invention disclosed herein deals with a device which is an improved indicator funnel having improved vertical stability.

Funnels are used in many applications involving the transfer of liquids from one vessel to another. For example kerosenes, gasolines and other volatile organic liquids are transferred in large volumes using funnels.

The use of funnels does not totally eliminate spillage of the liquids for many reasons, including overfilling due to the lack of any indication that an excess of liquid is being introduced to the interior of the vessel being filled. It is quite typical, for example, to guesstimate the amount of liquid in the vessel being filled and having the funnel entirely full when the vessel being filled has already reached its capacity.

Depending on the situation with regard to the type of liquid being transferred and the area or building in which the activity is taking place, this overflow, or spillage can have serious negative results. Thus, it would be an advantage to have a funnel that is not only a self-indicating type of funnel, but which has other valuable benefits that would reduce or entirely prevent such overflows and/or spillages.

BACKGROUND OF THE INVENTION

Indicator funnels in general are old in the art as can be witnessed by U.S. Pat. No. 721,870, issued to Thomas A. Edison on Mar. 3, 1903 in which there is described a funnel for filling storage batteries and analogous vessels.

Edison illustrates a type of indicator funnel which has a floating indicator rod, which rod has the capability of stopping the flow of liquid into the vessel being filled by the action of a plug on the bottom of the indicator rod which is forced into place by the liquid in the vessel being filled. The transfer of air that is being displaced from the vessel being filled is handled by a series of channels in the inverted cone-shaped portion of the funnel. This funnel suffers from the fact that it has indicator rod guide which extends beyond the top of the funnel creating storage problems for the funnel, as well as the propensity of the indicator rod guide being easily broken off. Further, it suffers from the fact that if there is any liquid left in the funnel when the lower end closes off, there is no convenient way for one to prevent the indicator rod from dropping from the funnel and releasing the contents thereof after the fill is complete, thus creating a spill situation.

A funnel similar to that described herein but not having the novel features of the instant inventive device can be found in Design Patent 334,120, issued Mar. 23, 1993

Another type of funnel that has the concept of indicating the flow of liquid into the vessel while filling is that device found in U.S. Pat. No. 4,796,470, issued Jan. 10, 1989 to Lahde. This device is designed such that the indicator rod is freely located in the spout of the funnel such that the funnel can be used in any operative position of the funnel. Thus, this device does not have an indicator rod guide and, does not have the means to vertically stabilize the funnel in an opening in a vessel to be filled.

Yet another device that is of the indicator type is that found in U.S. Pat. No. 986,535, issued Mar. 14, 1911 to Adams. This device has a metal indicator rod support which is located in the hollow interior of the lower spout of the funnel. This device does not have the ability to prevent the flow of liquid into vessel to be filled, or out of the funnel, but is designed purely for indication purposes. This device has the typical funnel configuration in the lower spout, of a truncated conical shape such that the funnel is insertable in an opening of a vessel to be filled until the outside diameter of the lower spout that matches the interior diameter of the opening is matched. However, this creates two problems. One, the funnel is not vertically stable with this configuration, and two, the funnel design does not conveniently provide for the escape of air from the vessel as the air is being displaced by the filling liquid. Also, this design allows for the binding of the indicator rod in the guide, as the guide allows for the float portion to move from side to side within the guide which brings the indicator rod out of alignment with its movement through the top portion of the guide. The higher the rod moves in the top guide, the more prevalent is this problem.

There is shown in U.S. Pat. No. 3,630,083, issued Dec. 29, 1971 to Gorans a fill indicator funnel having a tubular guide. Gorans eludes to the fact that prior art devices are complex and discusses these complexities and alleges that the device of his invention is simple. However, in comparison to the device of the instant invention, the Gorans device is complex, requiring several parts to be effective, while the device of the instant invention consists of only two major parts. Most notable about the device of the instant invention is the fact that the indicator tube is the float and the prior art devices consist of a rod which has a float material, such as cork, attached to the bottom thereof.

Finally, U.S. Pat. No. 4,901,776, issued Feb. 20, 1990 shows a funnel with a fill indicator in which the guide for the indicator rod extends well above the top planar surface of the funnel. The disadvantages of this device are analogous to those found in the Edison patent described above.

THE INVENTION

The invention herein deals with an improved indicator funnel having improved vertical stability when in use in a container to be filled.

Thus, what is disclosed herein is an indicator funnel having improved vertical stability wherein the funnel comprises a lower spout portion having a top end and a bottom end and a hollow interior. The lower spout portion is integrally joined and surmounted at the top end by an upper inverted cone-shaped portion to form an enlarged annular ring at the site of the joined portions. The improvements in the funnel comprise the enlarged annular ring which forms a shouldered support for the funnel. In addition the lower spout is enlarged and adapted to fit and stabilize the funnel in an opening such as an opening in a vessel to be filled with liquid to create vertical stability for the funnel in the opening.

Contained within the funnel is a hollow tubular float, the float being disengageable from the funnel, wherein the float has a bottom end and has a resting and an active position within the funnel.

The lower spout portion has a float guide fixedly centered in its hollow interior such that the float is freely movable therein and such that the float is capable of ascending in the float guide and being fully recessable in the bottom end of the lower spout such that the bottom end of the float is higher than the bottom end of the lower spout when the float is at a full active position within the funnel.

DETAILED DESCRIPTION OF THE INVENTION

Figure 1:
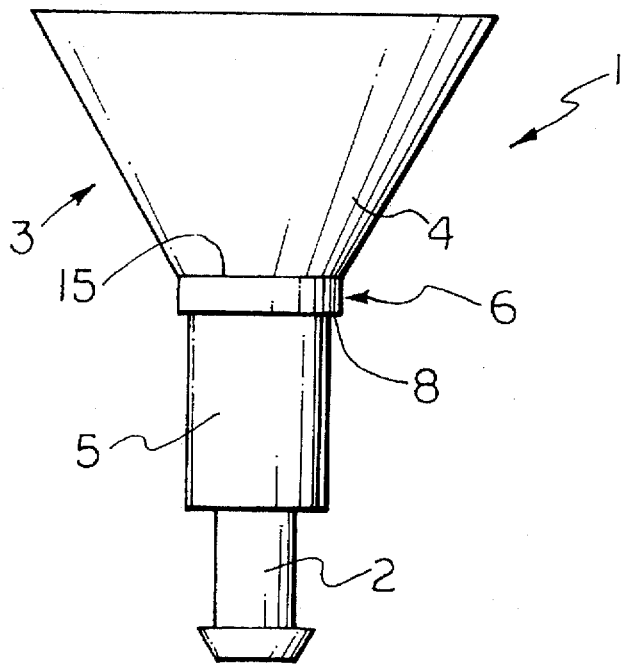
FIG. 1 is a full side view of the device of this invention.

Now, with reference to FIG. 1, there is shown a full side view of the funnel 1 of this invention in which there is shown the lower part of the hollow tubular float 2.

The funnel 1 is comprised of an top 3 comprised of an inverted conical portion 4. There is further shown a lower spout 5, and the top 3 and the lower spout 5 are integrally joined at point 6 to form an enlarged annular ring 7. The annular ring 7, it can be noted, is larger in diameter than the lower spout 5 and this causes a shoulder 8 to be formed. The benefits of the annular ring 7 is that in forming the shoulder 8, it can rest on the edge of an opening for most small gasoline containers and further the advantage of the enlarged lower spout 5 is that is creates vertical stability in the opening of such a container because of its enlarged size (essentially the diameter of most small standard gasoline containers), whereas, the smaller, especially truncated conical configured lower spouts of the prior art funnels do not have this advantage.

Beneath the annular ring 7, the enlarged lower spout 5 is shown with straight sides as opposed to a configuration found in prior art funnels which, as noted above, is a truncated conical configuration. What is meant by "enlarged" lower spout 5 for purposes of this invention is that the diameter of the lower spout 5 is on the order of one to one and a quarter inches in diameter for a normal five inch funnel, while prior art funnels are on the order of one-half inch for a five inch funnel, and thus, the diameter of the lower spout 5 in this invention is on the order of about two to two and one-half times larger in diameter. Further, in order to fully appreciate this invention, it should be noted that the overall length of the lower spout 5 is on the order of three and one-quarter to three and one-half inches for a five inch funnel, it being acceptable to exceed this length if desired.

Figure 3:
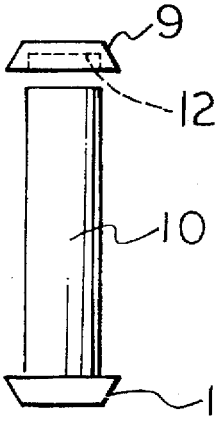
FIG. 3 is a full side view of the hollow tubular float used in this invention with the top cap shown in an exploded view.

Turning now to FIG. 3, there is shown a full size view of the hollow tubular float 2 of this invention. The hollow tubular float 2 is comprised of two parts, namely, the top cap 9 and the hollow tube 10 and bottom cap 11 in combination. In FIG. 3, the top cap 9 is shown exploded away from the hollow tube 10 in order to show the arrangement more clearly. The penetration of the tube 10 into the caps 9 is shown in phantom in the cap at shallow depression 12 and the cap 9 is held in place by the pressure of the hollow tube 10 against the interior walls of the depression 12, and thus, the cap 9 is a "snap-on" cap and is readily put into place and removed, while the bottom cap 11 is not removable.

For purposes of this invention, cap 9 can be snapped from the hollow tube 10, the capless tube 10 is then inserted into the funnel 1 though the float guide 14 (described infra) and the removed cap snapped back onto the hollow tube 10. When it is desired to remove the hollow tubular float 2, perhaps for repair or replacement, one of the cap 9 is removed and the hollow tubular float 2 is slipped from the float guide 14. It should be noted that in this invention, the indicator herein is not comprised of a rod, and a float attached to the rod, as is found in the prior art devices, but the hollow tubular float 2 of this invention serves as its own indicator rod without the need to connect together a float and a rod of some kind.

Figure 2:
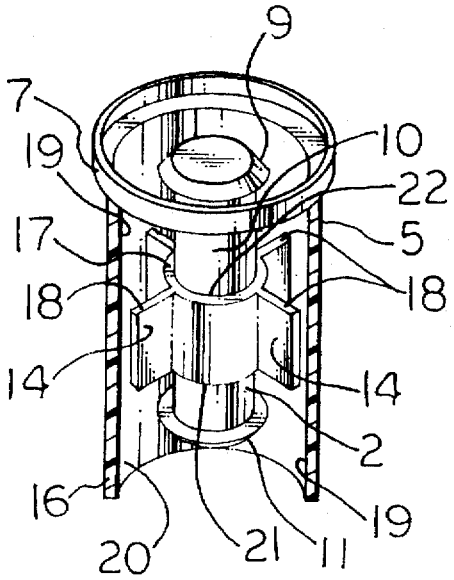
FIG. 2 is a cross sectional perspective view of a part of the device of FIG. 1 through the lines 2—2 of FIG. 1.

The lower cap 11 serves to provide a stop against the bottom end 21 of the float guide 14 for the hollow tubular float 2 when the hollow tubular float 2 is in its fully activated position and the cap 9 serves to provide a stop against the top end 22 of the float guide 14 when the hollow tubular float 2 is in its fully resting position as is shown in FIG. 2.

Turning now to FIG. 2, there is shown a view in perspective of the lower spout 5 containing therein the hollow tubular float 2 and the float guide 14. Also shown are the caps 9 and 11 of the hollow tubular float 2, the hollow tube 10, and the annular ring 7. The float guide 14 is situated in the lower spout 5 and begins at the top 15 (FIG. 1) of the annular ring 7 and extends down into the lower spout 5, but does not extend completely to the bottom end 16 of the lower spout 5 for reasons discussed infra. This float guide 14 has a length of about two and one-half inches on average for a five inch funnel, and the hollow tubular float 2 has a length of about three inches on average, including the caps 9 and 11. The length of the hollow tubular float 2 is not critical, and can be proportioned to the length of the lower spout 5, however, eventhough the length of the float guide 14 is not critical, it should have a length essentially commensurate with the length of the lower spout 5, except for the space that is necessary for the recession of the hollow tubular float 2 in the bottom end 16 of the lower spout 5 as is discussed infra.

The float guide 14 is comprised of a hollow circular member 17 with a series of fins or webs 18 fixedly connecting the hollow circular member 17 to the interior walls 19 of the lower spout 5. In FIG. 2, the float guide 14 is not shown as extending to the top 15 of the annular ring 7, and this is for illustration purposes only.

With regard to one of the benefits of the instant invention, it should be noted that the float guide 14 does not extend to the bottom end 16 of the lower spout 5, but stops short of such bottom end 16. This is to provide a recessed area 20 for the hollow tubular float 2 when it is in its fully activated position. The reason for this configuration is to allow a route by which the displaced air in a vessel being filled with a liquid can escape to the surface and not create bubbling and spillage by back pressure. This is especially critical when the vessel to be filled is essentially full, but has a very small amount of air to be released, as this is the point in the filling that the back pressure and consequent splashing of the liquid is the severest. The float guide 14 should be light in build in order to accommodate the removal of displaced air, yet should be of sufficient strength that it serves the function of the guide for the hollow tubular float 2.

In operation, the funnel is placed into an opening of a vessel to be filled whereby the enlarged lower spout 5 provides vertical stability. The hollow tubular float 2 of the funnel 1 is in a resting position such that the top cap 9 of the hollow tubular float 2 is resting against the top 22 at the site of the annular ring 7. The liquid to be transferred into the vessel to be filled is poured into the funnel 1 whereby the vessel is nearly filled to the top. At this point, the liquid contacts the cap 11 and the lower end of the hollow tubular float 2 which causes the hollow tubular float 2 to rise in the float guide 14. As the liquid nearly fills the vessel, as is indicated from the full extension of the hollow tubular float 2 into the inverted conical top section 4 of the funnel 1, the transfer of the liquid is stopped, the bottom cap 11 comes to rest at the bottom end 21 of the float guide 14, which removes the obstruction of the hollow tubular float 2 from the hollow interior of the lower spout 5, and allows the small amount of escaping air from the vessel to move up past the hollow tubular float 2 and the float guide 14 and escape to the outside, thus preventing any back pressure and consequent splashing and spilling of the liquid.

What is claimed is:

1. An indicator funnel having improved vertical stability, said funnel consisting essentially a lower spout portion having a top end and a bottom end and a hollow interior;

said lower spout portion being integrally joined and surmounted at the top end by an upper inverted cone-shaped portion to form an enlarged annular ring essentially at the site of the joined portions, the improvement comprising:

said enlarged annular ring forming a shouldered support for the funnel;

said lower spout portion being enlarged and adapted to fit and stabilize the funnel in an opening;

a hollow tubular float, said float being disengageable from the funnel;

said float having a bottom end and having a resting and an active position within the funnel;

said lower spout portion having a float guide fixedly centered in its hollow interior such that the float is freely movable therein and such that the float is capable of ascending in the float guide and being fully recessable in the bottom end of the lower spout such that the bottom end of the float is higher than the bottom end of the lower spout when the float is in a full active position within the funnel.

* * * * *